United States Patent [19]

Staltmeir et al.

[11] Patent Number: 4,650,040

[45] Date of Patent: Mar. 17, 1987

[54] BLOCK BRAKE FOR RAIL VEHICLES

[75] Inventors: Josef Staltmeir; Bernd Wosegien, both of Munich, Fed. Rep. of Germany

[73] Assignee: Knorr-Bremse AG, Munich, Fed. Rep. of Germany

[21] Appl. No.: 659,914

[22] Filed: Oct. 11, 1984

[30] Foreign Application Priority Data

Oct. 11, 1983 [DE] Fed. Rep. of Germany ..... 3336983

[51] Int. Cl.[4] ..... B61H 1/00; F16D 65/14

[52] U.S. Cl. ..... 188/207; 188/221.1

[58] Field of Search ..... 188/206 R, 214, 215, 188/220.6, 221.1, 250 F, 250 R, 250 B, 167, 74, 197, 198, 201, 207, 220.1, 196 V

[56] References Cited

U.S. PATENT DOCUMENTS

| | | | |
|---|---|---|---|
| 1,143,671 | 6/1915 | Weinland | 188/221.1 |
| 2,474,239 | 6/1949 | Flesch | 188/221.1 |
| 2;496,250 | 1/1950 | Light | 188/207 |

FOREIGN PATENT DOCUMENTS

| | | | |
|---|---|---|---|
| 1605853 | 4/1971 | Fed. Rep. of Germany . | |
| 0111742 | 12/1917 | United Kingdom | 188/198 |

*Primary Examiner*—Duane A. Reger
*Assistant Examiner*—Robert J. Oberleitner
*Attorney, Agent, or Firm*—Pollock, Vande Sande & Priddy

[57] ABSTRACT

In a block brake with brake block regulator, which maintains the brake block shoe (6) in a predetermined rotational position about its rotational axis (5) through friction blocks (20) and friction surfaces (14), the friction surfaces (14) are in the form of wedge surfaces, such that, upon rotation of the brake block shoe (6) under the influence of gravity, the friction blocks (20) must be forced back through the friction surfaces (14) against their spring loading (18). This enables compensation of the turning moment brought to bear on the brake block shoe (6) by the gravitational force.

10 Claims, 5 Drawing Figures

BLOCK BRAKE FOR RAIL VEHICLES

FIELD OF THE INVENTION

The invention relates to a block brake for rail vehicles, with a brake block shoe which is movable on the vehicle frame via at least one intermediate element at least substantially radially to the axle of a vehicle to be braked, and maintained rotatable about a rotational axis which is at least substantially parallel to this vehicle axis, the rotational axis being a a distance from the center of gravity of the brake block shoe, with a brake block regulator operative between the intermediate element and the brake block shoe, which regulator has in one of the members—brake block shoe or intermediate element—at least one slidably arranged friction block, which is resiliently forced against a friction surface of the other of the members—intermediate element or brake block shoe —relative rotations between the intermediate element and the brake block shoe about the rotational axis being frictionally hindered by relative displacements between friction block and friction surface.

BACKGROUND OF THE INVENTION

A block brake of the aforementioned kind is known from German Pat. No. 16 05 853. According to this publication, the brake block having a replaceable brake block shoe is suspended by means of the rotational axle on a pendulum lever serving as intermediate element. At the same time, the piston rod of a brake cylinder serving as push rod engages the rotational axle, the brake block shoe being clampable against the vehicle wheel by the force of this brake cylinder. In the pendulum lever, two friction blocks having a common axis parallel to the rotational axle are slidably supported, a spring forcing the friction blocks part being inserted therebetween. The spring forces the friction block against arcuate friction surfaces on the brake block shoe, the friction surfaces being arranged in planes perpendicular to the rotational axle. The rotational axle passes through the brake block shoe adjacent its end remote from the vehicle wheel, while, due to the relatively heavy brake block, the center of gravity of the brake bloc shoe is located adjacent the vehicle wheel; the force of gravity thereby exercises a constant torque on the brake block shoe about the rotational axle, which tends to disturb the existing setting of the brake block shoe through the brake block regulator, and which must be absorbed by the brake block regulator. The brake block regulator must therefore be made strong, with great friction force, but there is nevertheless no assurance that, particularly in the presence of hard, vertical travel shocks, the brake block shoe will not be turned out of its desired position.

OBJECT OF THE INVENTION

It is the object of the invention to provide a block brake of the type described above which, with simple construction and small manufacturing and maintenance costs, and while retaining the advantages of known brake block regulators, offers enhanced security against undesired or uncontrolled turning of the brake block shoe out of its desired position about the rotational axle.

SUMMARY OF THE INVENTION

This object is attained by means of the invention by making the friction surface as a wedge surface which forces the friction shoe back against its spring loading during gravity loaded rotation of the brake block shoe about the rotational axle. During rotation of the brake block shoe about the rotational axle in the direction of rotation, in which the torque resulting from gravitational force is operative, not only must the friction between friction block and friction surface be overcome, but additionally the friction block must be forced back against its spring loading, causing additional rotational resistance. It is easily possible to dimension the wedge angle of the wedge surface in such manner that the aforementioned additional rotational resistance just corresponds to the torque resulting from the gravitational force, and that hence this torque is compensated.

BRIEF DESCRIPTION OF THE DRAWINGS

The drawing illustrates exemplary embodiments of the block brakes according to the invention, and specifically

FIG. 1 shows a brake block unit 1 which, in desired, known manner is attached to a vehicle frame 2. The brake block unit 1 has a pendulum lever 3 which extends substantially vertically and has at its upper end a bearing 4 in the housing of brake block unit 1, and at its lower end a bearing with a rotational axis 5 on a brake block shoe 6. The brake block shoe 6 on one side has a conventional arcuate brake block 7, either connected thereto as a unit or replaceable, this brake block in the release position of the brake being located opposite the rolling surface 8 of a vehicle wheel 9 rotatable about an axis 34 at a clearing distance a. The rotational axis 5 is located adjacent the end of brake block shoe 6 which is remote from vehicle wheel 9. On rotational axis 5, additional to pendulum lever 3, a push rod 10 is articulated, which extends substantially radially away from vehicle wheel 9, and through which, in non-illustrated manner, a contact stroke and a clamping force from the brake block unit 1 is transferrable to the rolling surface 8 for the brake block shoe or its brake block 7. In the usual construction of brake block unit 1 with a brake cylinder (not shown) whose force operates on a merely indicated adjusting device 11 via a translational linkage (also not shown), the push rod 10 can constitute the threaded spindle of the adjustment device 11.

Figure 1:
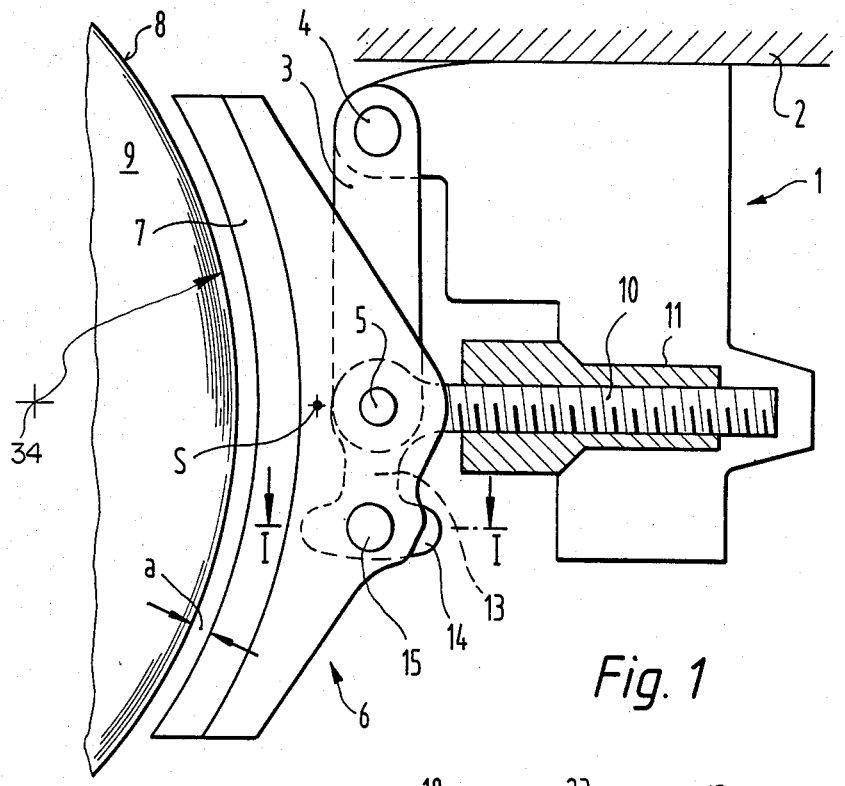
FIG. 1 shows schematically the entire construction of the block brake by way of a brake block unit.
Figure 2:
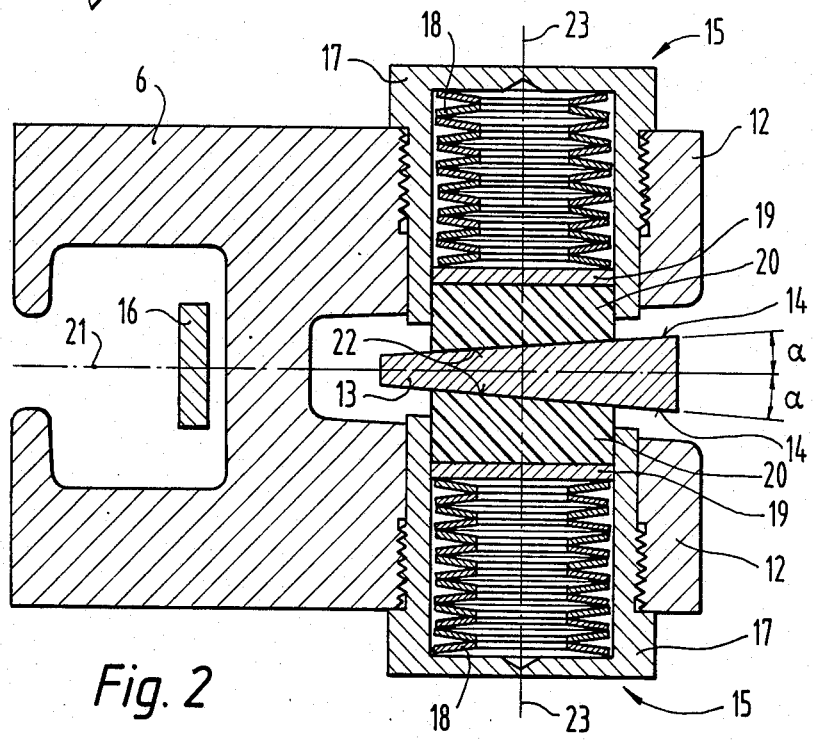
FIGS. 2 to 5 show different embodiments in partial section in enlarged scale.

The brake block shoe 6 is in double cheek form, i.e., it has two cheeks 12 offset in the direction of the rotational axis 5 parallel to the axe of the vehicle wheel 1, as shown in FIG. 2. According to FIG. 1, the pendulum lever 3 and the push rod 10 engage between cheeks 12, and are there supported on rotational axis 5. Beneath rotational axis 5, the push rod 10 is provided with a vertically downward projecting extension 13, which has near its lower end friction surfaces 14 on both sides, against which friction elements supported in cheeks 12 are pressed.

FIG. 2, which represents a section along line I—I of FIG. 1 in enlarged scale, shows the brake block shoe 6 with brake block 7 removed or omitted; a conventional resilient tongue mounting for the brake block 7 is indicated by reference numeral 16. The cheeks 12 which overlap with spacing the extension 13 according to FIG. 2 on both sides, have through bores coaxial with respect to one another and parallel to rotational axis 5, into which through bores pot-shaped friction element mountings 17 are tightly screwed. Each friction element mounting 17 contains a spring 18, preferably in the form of a disc spring, which loads a friction block 20 via an intermediate plate 19 in abutment direction against one of the friction surfaces 14 of extension 13. The intermediate plates 19 and friction blocks 20 are coaxially slidably supported in the friction element mountings 17. The extension 13 is wedge-shaped in the area of friction elements 20, such that the friction surfaces 14 form diverging wedge surfaces in the direction away from the vehicle wheel 9, which wedge surfaces, with respect to a reflection plane 21 perpendicular to the axis of friction elements 15 and therefore also to rotational axis 5 or the axle of vehicle wheel 9, extend at an angle $\alpha$; the friction surfaces 14 thus delimit the wedge with the wedge angle $2\alpha$.

On brake block shoe 6, brake block 7 constitutes a particularly heavy structural element. It is therefore obvious according to FIG. 1 that the center of gravity S of the brake block shoe 6 is closer to the vehicle wheel 9 than the rotational axis 5, and that the brake block shoe 6 thus is subjected to a constantly effective torque through the influence of gravity in counterclockwise direction as seen in FIG. 1. During rotation of brake block shoe 6 resulting from this torque, the friction elements 15 are displaced to the right, according to the section view of FIG. 2, relative to the fixedly maintained extension 13, whereby the friction blocks 20 run up onto the wedge formed by the friction surfaces 14 and are forced back against the forces of springs 18. During this displacement, not only must the friction effective between the friction blocks 20 and the friction surfaces 14 and proportional to the spring forces be overcome, but additionally the springs 18 must be compressed, so that an increased resistance to movment results. The angles $\alpha$ are appropriately so selected that the portion of the resistance to movement resulting from pressing back the friction blocks 20 and compressing the spring 18 just balances the torque exerted on the brake block shoe 6 by gravitatonal force so that the torque is compensated. The brake block shoe 6 is then rotatable in both rotational directions substantially only against frictional restraint brought to bear on the friction blocks 20 and the frictional surfaces 14 through friction contact, so that substantially the same resistance to movement is present in both rotational directions of the rotational movement.

The adjustment of the brake block shoe 6 relative to the rolling surface 8 of the vehicle wheel 9 occurs during braking, during which the brake block 7 is pressed fully against the rolling surface 8 preferably by its entire surface facing the vehicle wheel 9. During subsequent release of the brake, the push rod 10 being displaced to the right, as shown in FIG. 1, carries along the brake block shoe 6, whereby it is held fast in its then prevailing rotational position through friction contact of the friction blocks 20 with the friction surfaces 14, and uniform lifting of the brake bloc 7 from the rolling surface 8 by clearance distance a results.

In the embodiment according to FIG. 2, the two friction elements 15 are arranged coaxially; this requires that the fronta surfaces 22 of the friction blocks 20 facing friction surfaces 14 are inclined at the angle $\alpha$ to a common axis 23 of the friction elements 15. The friction blocks 20 must therefore be located in the friction elements 15 at a specific rotational position about axis 23. In the embodiment according to FIG. 3, this is not the case; here the friction blocks 20 can be located at any desired rotational positions about the axes 23 of the friction elements 15.

Figure 3:
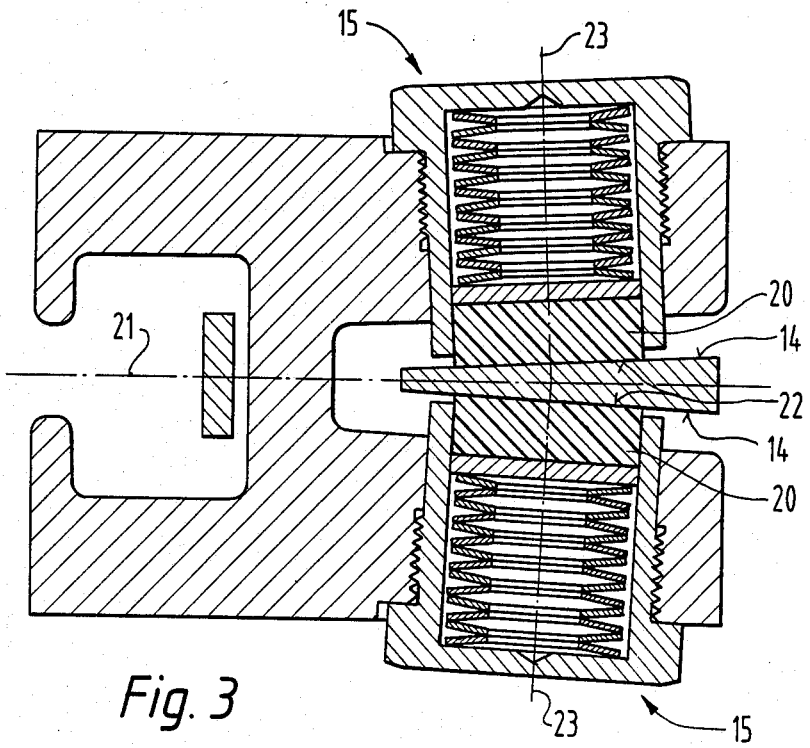

In the arrangement according to FIG. 3, the friction elements 15 are not arranged coaxially but inclined to one another, such that the two axes 23 of the friction elements 15 intersected approximately in the reflecting plane 21; each friction axis 23 is perpendicular to the friction surface corresponding to its friction element 15. The friction blocks 20 here also have frontal surfaces 22 on the sides of friction surfaces 14, extending perpendicularly to the respective axes 23. In other respects, the construction according to FIG. 3 corresponds to that of FIG. 2, and thus need not be further described. The friction blocks 20 can here occupy a desired rotational position about the axis 23 in the friction elements 15.

Figure 4:
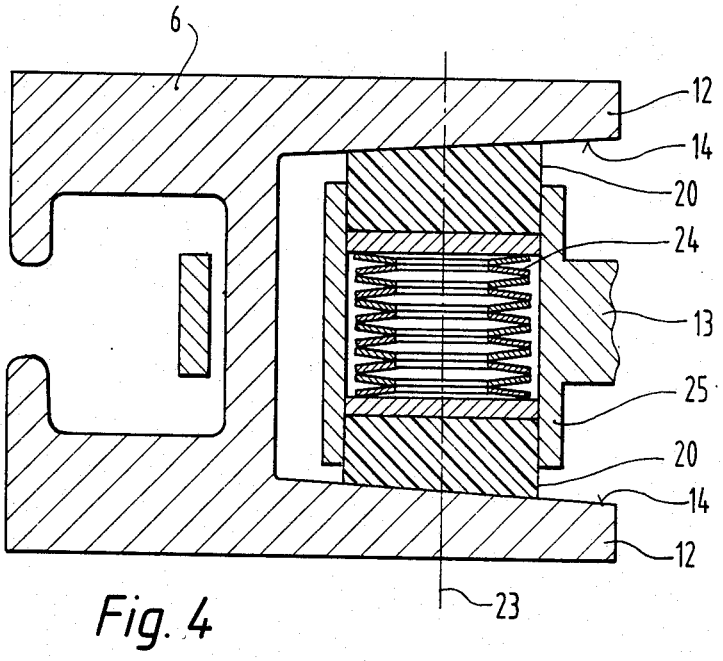

Particularly when the friction blocks 20 are arranged coaxially, reduction in the constructional costs is also possible by providing only one common spring 24 for both friction blocks 20, which spring tends to spread the two friction blocks apart and thereby forces them against the friction surfaces 14. According to FIG. 4, the two facing surfaces of the two cheeks 12 are in the form of friction surfaces diverging in the direction away from the vehicle wheel 9. The spring 24 and the two friction blocks 20, prestressed to enclose the same between them, are slidably supported in a cylinder interior guideway 25; the guideway 25 is located on extension 13. The axis 23 of the guideway 25, of friction blocks 20 and of spring 24 extends substantially parallel to rotational axis 5. In other respects, the structure of the arrangement according to FIG. 4 corresponds substantially to that of FIG. 2, so that it requires no further explanation. THe operation of the arrangement according to FIG. 4 also corresponds substantially to that of the device according to FIG. 2, so that additional details may be omitted.

Figure 5:
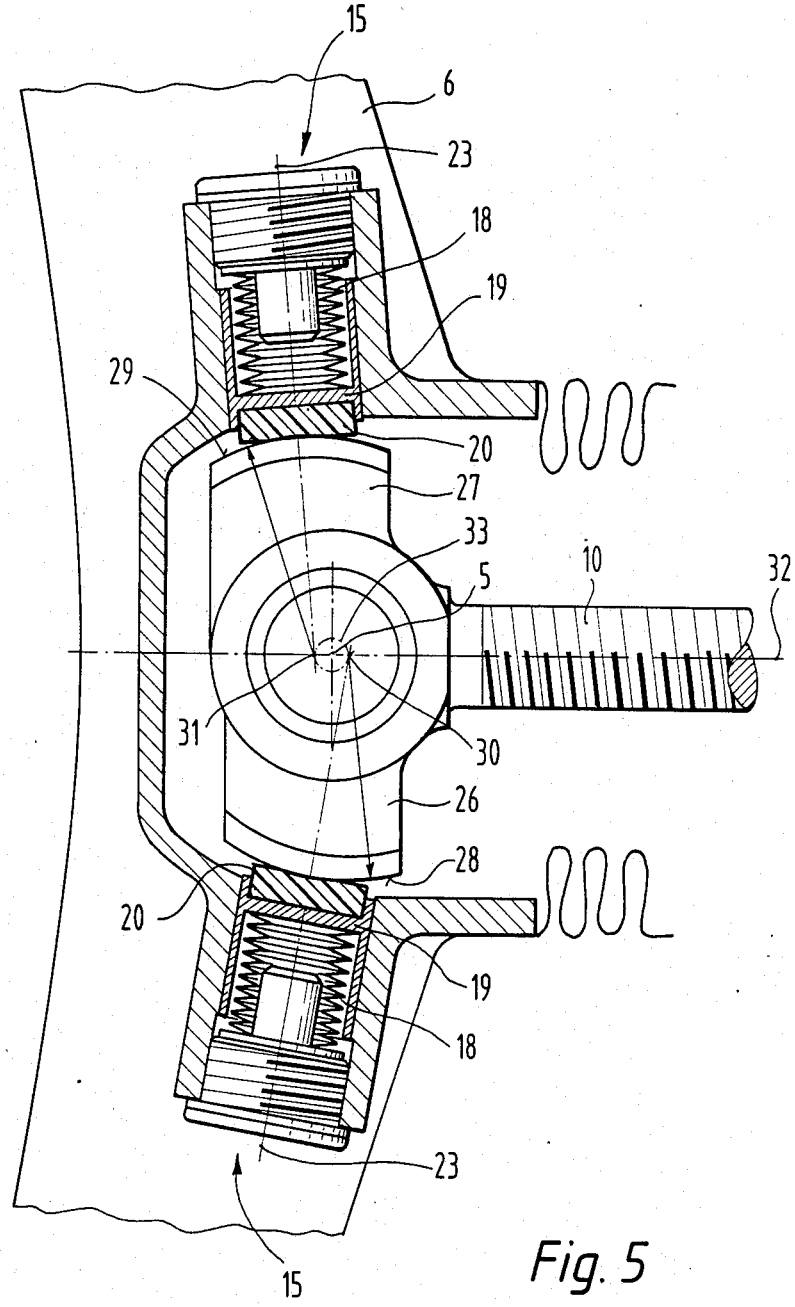

In the block brake according to FIG. 5, the push rod 10 in the region of the rotational axis 5 has a downwardly projecting extension 26 and an upwardly projecting extension 27. The extension 26 terminates with a cylindrical friction surface 28, and the extension 27 with an also cylindrical friction surface 29. The cylinder axes 30 and 31 of the two friction surfaces 28 and 29, which axes are parallel to the rotational axis 5, cut small circular arcs about the rotational axis 5 at those locations at which the axes 23of the two friction elements 15 are tangent to the circular arcs have the same diameter and hence form a circle 33. The cylinder axis 30 extends farther and the cylinder axis 31 closer to the vehicle wheel 9 than the rotational axis 5. In a variant, simplified construction it is also possible to arrange the cylinder axes 30 and 31 on both sides of the rotational axis 5 coplanar therewith and therefore also coplanar with the longitudinal axis 32 of the push rod 10. The two friction elements 15 are in principle formed similar to the friction elements according to FIG. 2, only the intermediate plates 19 have both guide casings for the springs 18 and mounting sections for the friction blocks 20. The two friction elements 15 are, according to FIG. 5, arranged in the brake block shoe 6 and below the rotational axis 5, such that their axes are only slightly inclined to the vertical and that the friction blocks 20 may be pressed against the friction surfaces 28 and 29 upon rotation of the brake block shoe 6 in the clockwise direction according to FIG. 5, whereby upon such a rotation the friction blocks 20 are forced together against their spring loading. By appropriate dimensoning, a compensation of the torque acting through gravity upon the brake block shoe 6 is possible also in the case of this embodiment.

Depending on the friction conditions of the friction blocks 20 in their guideways, hystereses may appear in all the structure described hereinabove with respect to the torques required for rotation of the brake block shoe 6 in one or the other rotational direction, but such hystereses are not particularly disturbing.

As a variant to the embodiments described hereinabove, in which the friction surfaces 14 or 28 and 29 each form double wedges, it is also possible to provide, in place of in each case two friction elements 15 and two friction surfaces 14 or 28 and 29, in each case only one friction element 15 and one friction surface 14, or 28 or 29. The friction angle $\alpha$ or the diameter of the circle 33, i.e., the wedge slope, will then be appropriately steeper than in the preceding embodiments.

In the embodiments described hereinbefore, the brake block regulators enclosing the friction blocks 20 and the friction surfaces 14, 28, 29 are distributed on brake block shoe 6 and on elements fixedly connected with the push rod 10. It is of course also possible to provide, instead of the said elements, the pendulum lever 3, such that the brake block regulators operate between the brake block shoe 6 and the pendulum lever 3. However, in this embodiment there is no uniform lifting of the brake block shoe from the rolling surface 8 during brake release, since the brake block shoe rotates during the brake release process with the pendulum lever 3 and the upper bering 4 of the latter.

What is claimed is:

1. Block brake for rail vehicles, with a brake block shoe (6) attached to a vehicle frame (2) by means of at least one intermediate elemet (3, 10) movable at least substantially radially to an axle (34) of a vehicle wheel (9) to be braked, and rotatable about a rotational axis (5) at least substantially parallel to said axle, said rotational axis (5) being spaced from the center of gravity (S) of said brake block shoe (6), with a brake block regulator, operative between said intermediate element (3, 10) and said brake block shoe (6), which has at least one slidably retained friction block (20) in one of said brake block shoe (6) and said intermediate element (3, 10) which is resiliently forced against a friction surface (14, 28, 29) of the other of said intermediate element (3, 10) and brake block shoe (6), relative rotations between said intermediate element (3, 10) and said brake block shoe (6) about said rotational axis (5) being frictionally hindered through relative displacements between said friction block (20) and said friction surface (14, 28, 29), said friction surface (14, 28, 29) constituting a wedge surface which forces back said friction block (20) against spring loading of the latter upon gravity induced rotation of said brake block shoe (6) about said rotatonal axis (5).

2. Block brake according to claim 1, with two friction blocks (20) and friction surfaces (14) arranged with respect to a reflection plane (21) which at least substantially contains said rotational axis (5), wherein said friction surfaces (14) form a double wedge.

3. Block brake according to claim 2, wherein said friction blocks (20) and friction surfaces (14) are arranged in at least substantially mirro-inverted fashion.

4. Block brake according to claim 2, wherein said two friction blocks (20) are provided with loading springs (18), said friction blocks and said loading springs being arranged coaxially, and frontal surfaces (22) of said friction blocks (20) which face said friction surfaces (14) being inclined by a wedge angle ($\alpha$) of the wedge surfaces (14) to a plane (21) perpendicularly intersecting a common axis (23) of said friction blocks (20).

5. Block brake according to claim 4, wherein said two friction blocks (20) are loaded in spreading apart direction by a spring (24) clamped between them.

6. Block brake according to claim 2, wherein each said friction block (20) and its associated spring (18) extends at right angles to said friction surface (14) related to the respective friction block (20).

7. Block brake according to claim 1 or 10, wherein said friction surfaces (28, 29) are in the form of arcuate curved surfaces about said rotational axis (5).

8. Block brake according to claim 7, wherein said friction surfaces (28, 29) are in the form of cylinder surfaces about cylinder axes (30, 31) offset with respect to said rotational axis (5) generally in radial direction of the axle of said vehicle wheel (9).

9. Block brake according to claim 8, especially block brake unit, in which said brake block shoe (6)is guided for application against the vehicle wheel (9) by means of a push rod (10) longitudinally movable substantially radially to the axle of said vehicle wheel, wherein the intermediate element comprising parts of the brake block regulator is said push rod (10).

10. Block brake for rail vehicles with a brake block shoe (6) attached to a vehicle frame (2) by means of at least one intermediate element (3, 10) movable at least substantially radially to an axle (34) of a vehicle wheel (9) to be braked, and rotatable about a rotational axis (5) at least substantially parallel to said axle, said rotational axis (5) being spaced from the center of gravity (S) of said brake block shoe (6), with a brake block regulator, operative between said intermediate element (3, 10) and said brake block shoe (6), which has two slidably retained friction blocks (20) in one of said brake block shoe (6) and said intermediate element (3, 10) which is resiliently forced against a friction surface (14, 28, 29) of the other of said intermediate element (3, 10) and brake block shoe (6), relative rotations between said intermediate element (3, 10) and said brake block shoe (6) about said rotational axis (5) being frictionally hindered through relative displacements between said friction block (20) and said friction surface (14, 28, 29), said friction surface (14, 28, 29) constituting a wedge surface which forces back said friction block (20) against spring loading of the latter upon gravity induced rotation of said brake block shoe (6) about said rotational axis (5), said friction blocks (20) and friction surfaces (14) being arranged with respect to a reflection plane (21) which at least substantially contains said rotational axis (5), said friction surfaces (14) forming a double wedge.

* * * * *